United States Patent [19]

Berghahn et al.

[11] 4,111,567

[45] * Sep. 5, 1978

[54] LIQUID APPLICATOR

[75] Inventors: Walter G. Berghahn, Scotch Plains; Jack Weinstein, Old Bridge, both of N.J.

[73] Assignee: Bristol-Myers Company, New York, N.Y.

[ * ] Notice: The portion of the term of this patent subsequent to Sep. 27, 1994, has been disclaimed.

[21] Appl. No.: 758,984

[22] Filed: Jan. 13, 1977

Related U.S. Application Data

[63] Continuation-in-part of Ser. No. 657,345, Feb. 11, 1976, Pat. No. 4,050,826.

[51] Int. Cl.[2] ..... B43K 5/00

[52] U.S. Cl. ..... 401/202; 401/205; 401/215

[58] Field of Search ..... 401/196–207, 401/213

[56] References Cited

U.S. PATENT DOCUMENTS

| | | | |
|---|---|---|---|
| 2,666,416 | 1/1954 | Rickmeyer | 401/196 |
| 3,767,520 | 10/1973 | Dick et al. | 401/196 X |
| 4,050,826 | 9/1977 | Berghahn et al. | 401/196 |

FOREIGN PATENT DOCUMENTS

| | | | |
|---|---|---|---|
| 2,151,741 | 5/1973 | Fed. Rep. of Germany | 401/202 |
| 6,503,412 | 9/1966 | Netherlands | 401/196 |

*Primary Examiner*—Stephen C. Pellegrino
*Attorney, Agent, or Firm*—Irving Holtzman; George A. Mentis; David J. Mugford

[57] ABSTRACT

A liquid applicator which comprises a liquid storage container fitted with a shaped applicator means that is made of a non-flexible, non-deformable, sintered, porous synthetic plastic resin having a controlled porosity and having omni-directional interconnecting pores.

10 Claims, 7 Drawing Figures

LIQUID APPLICATOR

COPENDING CASES

This application is a continuation-in-part of application Ser. No. 657,345 filed Feb. 11, 1976, now U.S. Pat. No. 4,050,826.

This invention relates to a liquid applicator. More particularly, it concerns a liquid applicator that is especially adapted to apply a liquid to the axilla of humans. The present invention has particular utility in applying liquid antiperspirant or deodorant products to the human axilla.

A large variety of liquid applicators have been disclosed in the prior art. Perhaps one of the most widely used applicators is of the so-called ball roll-on type applicator. These are exemplified in U.S. Pat. Nos. 2,749,566; 2,923,957 and 2,998,616 and rely on the fact that the ball rotating in the liquid contained in a bottle picks up the liquid as it dips into the contents of the container and applies it to the body area on which the ball is rolled.

Although these applicators have enjoyed wide use, they have presented some problems. Chief among these has been the fact that the liquid product tends to accumulate on the ball and crystallize. This often results in unsightly deposits on the ball. Moreover, the ball often becomes "frozen" so that it will not readily rotate when applied to the body area.

It has also been suggested in the prior art to construct liquid applicators which comprise a container for holding the liquid to be dispensed and an applicator means positioned on the open end of the container; the applicator means comprising a distortable porous or microporous member. These porous members, in general, are in communication with the liquid contents of the container and they permit the liquid material to flow through its pores. However, these devices ordinarily require that the applicator means be mechanically or otherwise squeezed to deliver the product. Typical devices of this character are described in U.S. Pat. Nos. 3,179,972 and 3,482,920. Devices of these types have the disadvantage in that it is substantially impossible to deliver uniform doses of the liquid contents of the container. This is so because the quantity of material delivered to a substantial extent is dependent upon the pressure that is applied when dispensing these materials. This pressure cannot readily be regulated from one application to another.

In application Ser. No. 657,345 it was disclosed that the above difficulties may be avoided and a highly effective and useful liquid applicator may be provided if the applicator means is constructed as a shaped form made from a non-flexible, non-deformable, sintered porous synthetic plastic resin structure having a controlled porosity and having omni-directional interconnecting pores. It was also disclosed therein that some of the liquid overflow problems encountered in a liquid applicator of the aforesaid type can be avoided by providing a liquid collecting channel adjacent said shaped applicator means as described in more detail below.

It has now been further found that over extended periods of use of the applicators described in Ser. No. 657,345 that certain difficulties are encountered. Thus, as the contents of the container become depleted through use, it becomes more and more difficult to dispense the contents of the container through the sintered porous member. When an effort was made to relieve this by providing an air vent into the interior of the container, it was found that the flow of liquid through the sintered porous member was too rapid and not controllable. However, if in combination with said vent, means is also provided for restricting or impeding the flow from the interior of said container to the underside of said sintered porous member that a very suitable dispenser is obtained.

It is accordingly an object of this invention to provide an improved liquid applicator which avoids some of the problems of the prior art devices of this character.

It is also an object of this invention to provide an improved liquid applicator adapted to deliver said liquid in convenient and efficient manner and in uniform doses.

It is a further object of this invention to provide a liquid applicator that employs as the liquid applicator means shaped forms constructed of a non-flexible, non-deformable, sintered, porous synthetic plastic resin having a controlled porosity and having omni-directional interconnecting pores.

It is still an additional object of the present invention to provide a liquid applicator of the aforesaid type having means for collecting the liquid overflow coming through the pores of the applicator means.

It is another object of this invention to provide a liquid applicator that employs as the liquid applicator means shaped forms constructed of a non-flexible, non-deformable, sintered, porous synthetic plastic resin having a controlled porosity and having omni-directional interconnecting pores; said liquid applicator being provided with venting means to the interior of the container and also being provided with means for restricting the flow of liquid in the container to the underside of the liquid applicator means.

Other and more detailed objects of this invention will be apparent from the following description, claims and drawings wherein:

FIG. 3 is an enlarged, longitudinal cross-sectional view of the device shown in FIG. 2 with the shaped applicator in position and with the screw cap partially screwed into position;

Figure 7:
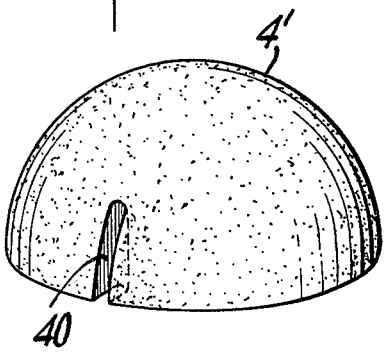
Figure 6:
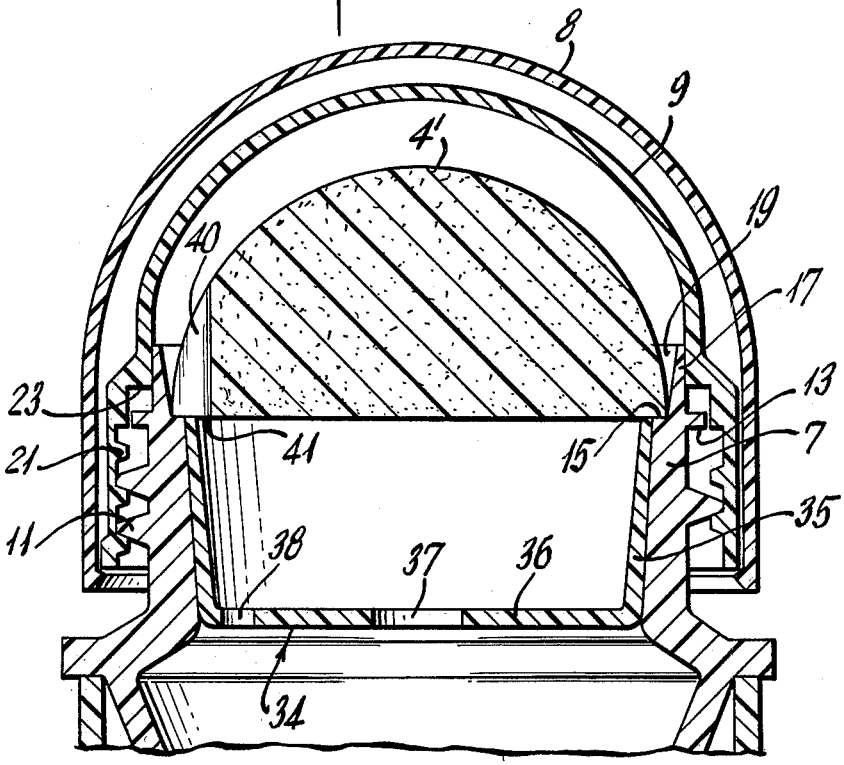

FIG. 6 is an enlarged longitudinal cross-sectional view of the upper portion of still another modification of this invention showing venting means cut into the applicator and means for restricting the flow of liquid to the undersurface of the applicator means; and FIG. 7 is a perspective view of the applicator means shown in the applicator of FIG. 6 as it appears when it is removed from its position in the applicator.

Figure 1:
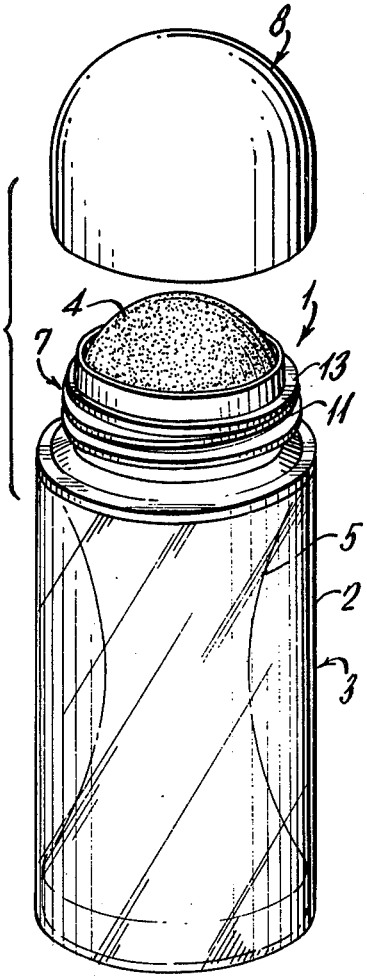
FIG. 1 is a perspective view of a device encompassed in this invention showing the cap in removed position.

Referring now to the drawings in which like numerals identify the same structure in the various views, a liquid applicator embodied in the present invention is shown at 1 in FIG. 1. This comprises a container shown generally at 3 consisting of a container body section 5 and a container neck section 7. Mounted in neck 7 in a manner described in more detail below is applicator 4. A screw cap 9 is provided which is adapted to engage neck 7 as hereinafter described.

In the embodiment illustrated, container body has an hour glass shape. This is fitted with a transparent removable sleeve 2 that slips over body 5 from below. However, it is obvious that container body 5 may have various shapes without departing from this invention.

Figure 2:
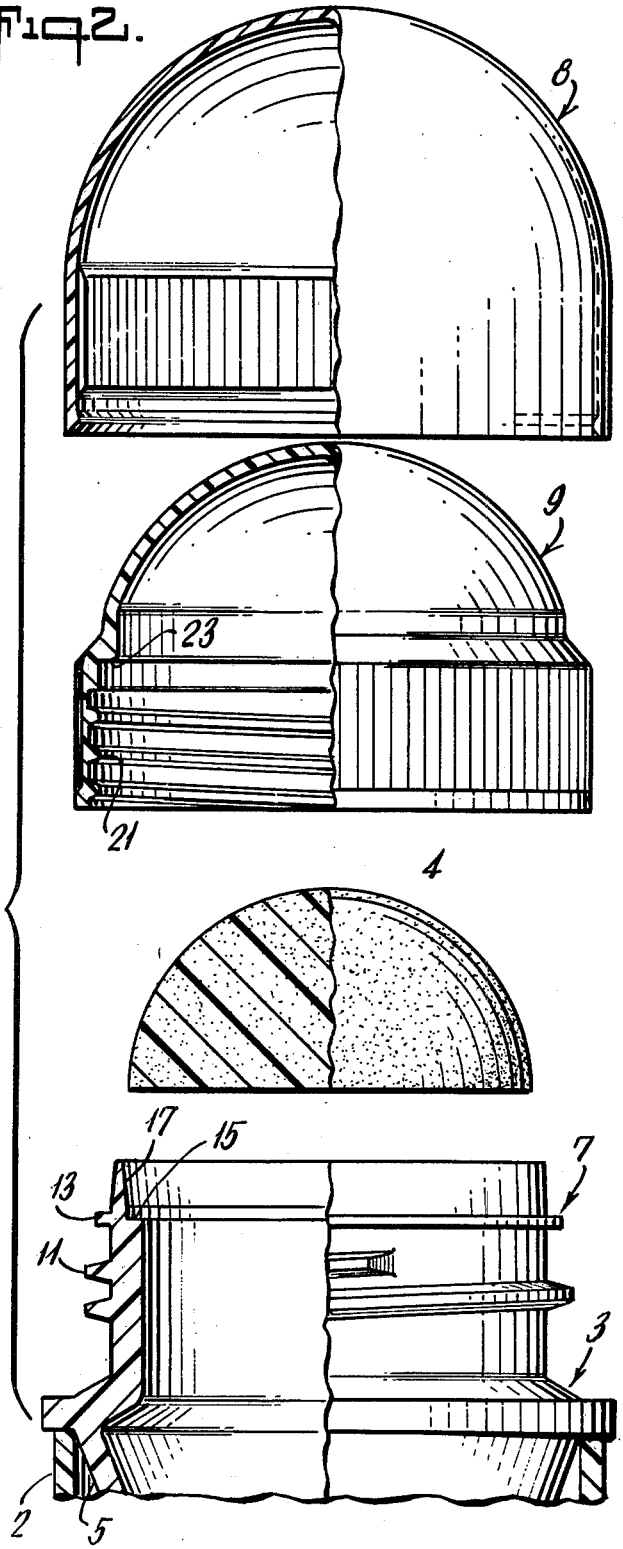
FIG. 2 is an exploded and enlarged view partly in section of the upper portion of the device shown in FIG. 1 and including an overcap.

Neck 7, on its external surface, is provided below with external threads 11 and above with sealing flange 13. On its internal surface, as best seen in FIGS. 2 and 3, neck 7 is provided with step 15 that serves to support applicator 4. The internal surface of neck 7 that extends above step 15 for a short distance is generally at right angles to step 15 and then flares outwardly at 17. As best seen in FIG. 3, flare 17 serves to form collecting channel 19 when applicator 4 is seated in position on step 15. The internal diameter of neck 7, above and adjacent step 15, is dimensioned to be slightly smaller than the diameter of hemispherical applicator 4. In this fashion, applicator 4 can be releasably maintained in position in neck 7 by a friction fit.

Screw cap 9 is provided on its inner surface below with internal threads 21 that are adapted to mesh with external threads 11 of neck 7. Above and on its internal surface, screw cap 9 has a sealing surface 23 that is designed to form a tight seal when the screw cap is screwed down so that surface 23 abuts against the upper surface of flange 13.

Figure 4:
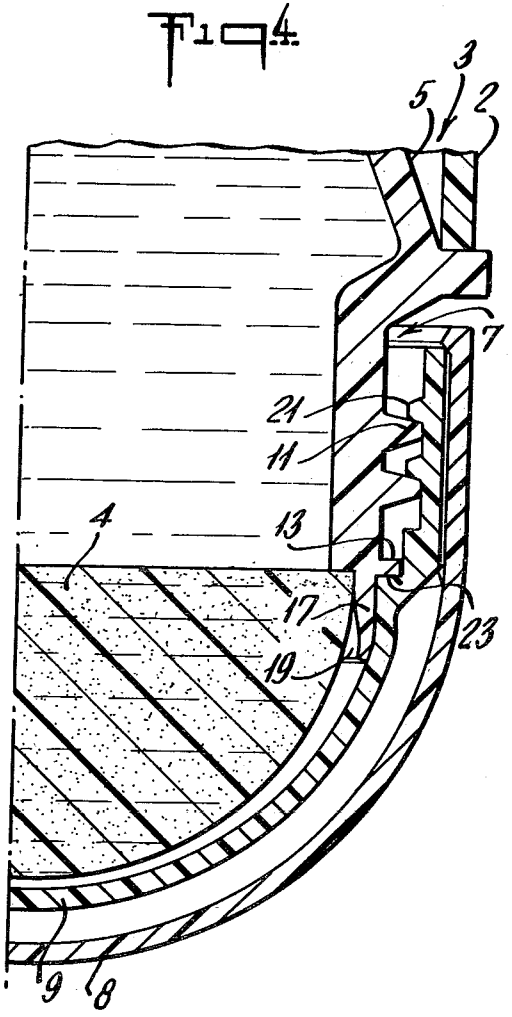
FIG. 4 is an enlarged view similar to that shown in FIG. 3 with the screw cap screwed into sealing position, the container being inverted to show the relationship of the liquid to the applicator means.
Figure 5:
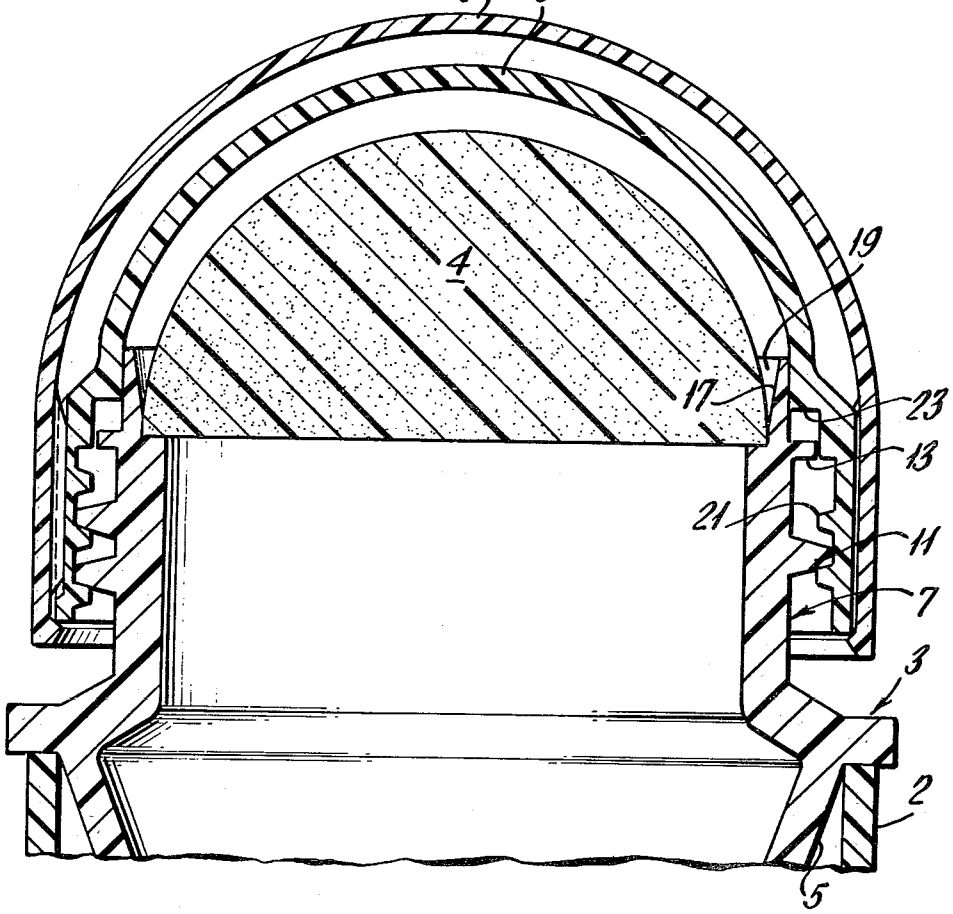
FIG. 5 is an enlarged longitudinal cross-sectional view of the upper portion of another modification of this invention showing venting means in the neck of the container and means below the applicator means for restricting the flow of liquid to the undersurface of the applicator means.
Figure 5:
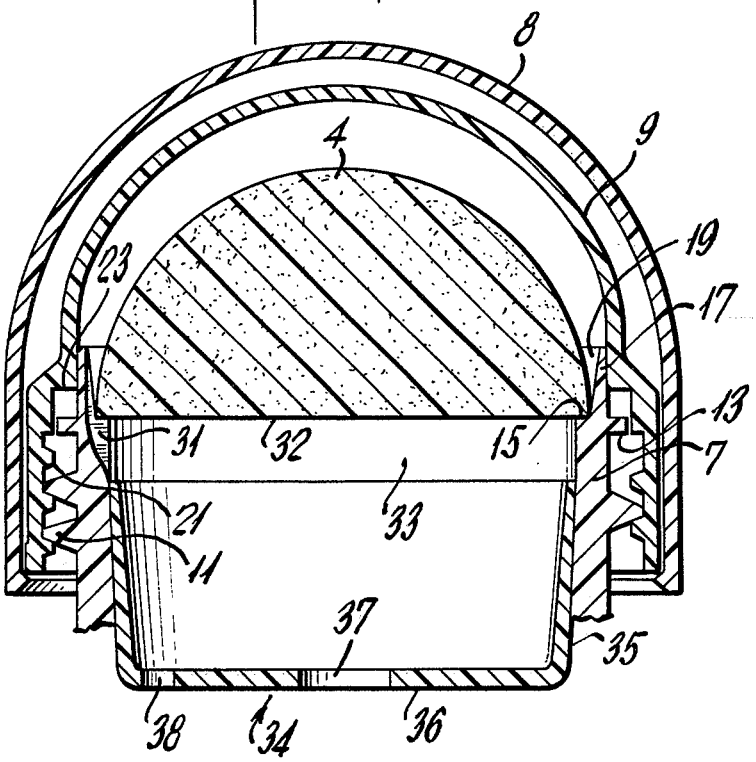

In the modification of this invention illustrated in FIG. 5 the construction is the same as that shown in FIGS. 1–4 with a few exceptions. Thus, in this modification a vertically extending vent 31 is cut in the inner wall of neck 7. This is a narrow vertical channel that extends from the base of collecting channel 19 to a point below the undersurface 32 of applicator 4. This brings the space 33 underneath applicator 4 into communication with the atmosphere when screw cap 9 and overcap 8 are removed.

Fitted into neck 7 is a fluid restricting means 34. This takes the form in the modification shown in FIG. 5 of a cylindrically shaped basket open at the top having an annular shaped wall 35 and a floor 36. Fluid restricting means 34 is secured in neck 7 by means of a friction fit or by any other suitable means.

To permit a restricted flow of liquid from the interior of the container to the underside of applicator 4, one or more openings are provided in floor 36. In the modification shown in FIG. 5 this takes the form of a larger circular opening 37 located at about the geometric center of floor 36 and a smaller circular opening 38 located near the circumference of floor 36.

The modification of this invention illustrated in FIGS. 6 and 7 is similar to that shown in FIG. 5 excepting for the venting means. In this case, a vertical venting channel 40 is cut into the surface of applicator 4' as best seen in FIG. 7. Applicator 4' is in all other respects the same as applicator 4. When applicator 4' is seated in place on step 15, the inner end 41 of venting channel 40 is positioned inwardly of the inner surface of wall 35. Inner end 41 thus provides an opening into the space below applicator 4' which may communicate with the atmosphere when screw cap 9 and overcap 8 are removed.

As mentioned above, the applicator element is shown at 4 or 4' in the various views of the drawings. In the embodiments illustrated applicators 4 and 4' take the form of a shaped hemispherical structure. This form of the applicator is especially suitable for the application of liquids to the axilla of humans.

The materials used to fabricate the applicator 4 or 4' of this invention are highly important aspects thereof. Thus, as pointed out above, the applicator will be a shaped, non-flexible, non-deformable, sintered porous synthetic plastic resin having a controlled porosity and having omni-directional interconnecting pores. They are formed as interconnected aggregates of united particles of said synthetic resin. Moreover, they constitute a substantially uniform cohesive reticular structure which extends from surface to surface of the shaped applicator.

Through the use of such materials in making the applicator element of 4 or 4' of the present invention, a uniform and controlled rate of flow of the liquids from the interior of the container is made possible. As a consequence, any undue wetting of the area to which the applicator is applied is avoided. This controlled flow of liquid is accomplished by the fact that the passage of the liquid through the applicator is largely by means of the capillary action of the pores that are present in the materials. This capillary action can be regulated by regulating the size of the pores.

Moreover, the use of these materials in constructing the applicator element of 4 or 4' makes it possible to tailor the applicator to the viscosity of the liquid to be dispensed from the container. By selecting the appropriate pore size relative to the viscosity of the liquid, a desired rate of flow of product can be obtained.

A number of sintered synthetic plastic materials are known in the prior art which may be used in fabricating the applicator element 4 or 4' of the present invention. Among these mention may be made of sintered resins of the following type: high density polyethylene, low density polyethylene, ultra high molecular weight polyethylene, polypropylene and polyvinylidene fluoride resins (fluorocarbons). Several of these materials are available commercially under the trade designation "Porex" porous plastic. These materials are identified in the Table below together with some of their characteristics:

PHYSICAL PROPERTIES OF POLYMERS

| Polymer | Coefficient of Thermal Expansion | Density at 40% Void Volume | Average Pore Size in Microns |
|---|---|---|---|
| Low Density Polyethylene | $10\text{–}20 \times 10^{-5}$ IN/IN/° C Up to 170° F | .56 g/cc | 70, 120 |
| High Density Polyethylene | $11\text{–}13 \times 10^{-5}$ IN/IN/° C Up to 200° F | .6 g/cc | 10, 35, 70, 120 |
| Ultra high molecular weight polyethylene | $13 \times 10^{-5}$ IN/IN/° C Up to 200° F | .58 g/cc | 10, 20 |
| Polypropylene | $5\text{–}10 \times 10^{-5}$ IN/IN/° C Up to 250° F | .54 g/cc | 125, 250, 300, 500 |
| Fluorocarbon (PVF2) (polyvinylidene fluoride) | $5 \times 10^{-5}$ IN/IN/° C Up to 300° F | 1.05 g/cc | 25, 35, 49 |

Similar materials are also disclosed in U.S. Pat. Nos. 3,055,297 and 3,778,495.

The pore size of applicator 4 or 4' may vary somewhat depending on the particular liquid that is to be dispensed. Generally, the more viscous the product, the larger will be the pore size. Ordinarily, however, for the most usual applications, this will be in the range of from about 10 to 500 microns and preferably from about 20 to 200 microns. For solutions, the pore size is advantageously of the order of from about 20 to 35 microns; whereas, for lotions, this will be in the range of from about 150 to 200 microns.

The patent to Gazzani U.S. Pat. No. 3,403,961 discloses a device for distribution of liquids which includes a pad made of porous flexibly deformable material that is to serve as the application means. As an aside and in very general and ambiguous terms, the patentee also suggests the applicator means may be of a "porous and rigid nature." In further describing this, the patentee also states that the applicator may be "a cap of naturally porous material which is of material made porous by a plurality of small holes." The kind of material the patentee has in mind is not specified and is very vague. However, it is clear that this is no teaching of the use of the sintered porous resins used in this invention.

Any of a variety of materials may be used in fabricating the container 3 and screw cap 9 of the present invention. Ordinarily, these will be made of resilient synthetic plastic resins such as polyethylene or polypropylene.

In use the container body 5 is filled with liquid and then the applicator 4 or 4' is pushed into place so that it rests on step 15. As previously mentioned, the diameter of the hemispheric applicator 4 or 4' is made slightly larger than the internal diameter of neck 7 just adjacent and above step 15. To apply the liquid material, the container is inverted as shown in FIG. 4. This brings the liquid in contact with the bottom surface of applicator 4 or 4'. In this position, under the influence of the capillary action of the pores of applicator 4 or 4', the liquid enters the applicator and flows through it at an even and controlled rate. It reaches the surface relatively quickly and is applied to the part of the body in contact with the applicator 4 or 4'.

After use the container is turned upright and stored. Ordinarily, the liquid will drain back into the container through the pores. However, if an excess of liquid accumulates on the surface of applicator 4 or 4', it runs down and collects in collecting channel 19. This prevents excess liquid from flowing down the outside surface of neck 7. When the applicator is stored after use, collecting channel 19 serves as temporary reservoir. The liquid contained in channel 19 will then drain back into container body 5 through the pores of applicator 4 or 4'.

As an optional feature, the present liquid dispenser may also be provided with a flexible overcap 8. This may be slipped over screw cap 9 and held in position by engaging the lower margin of screw cap 9.

What is claimed is:

1. A liquid applicator suitable for use in the application of liquids to a surface of the human body comprising a container having a container body adapted for storing a quantity of said liquid, said container having an opening at one end thereof which is provided with an upper margin, step means spaced below said upper margin of said opening and extending inwardly from the walls of said opening, said step means being adapted to support a shaped applicator means; shaped applicator means being secured and positioned in said opening and resting on said step means; said shaped applicator means comprising a non-flexible, non-deformable, sintered, porous synthetic plastic resin structure having a controlled porosity and having omni-directional interconnecting pores, said applicator including venting means for venting the interior of said container to the atmosphere and barrier means for restricting the flow of liquid from within the interior of said container body to said shaped applicator, said venting means comprising a continuous and unobstructed path extending from the atmosphere to the interior of said container.

2. A liquid applicator according to claim 1 in which said restricting means comprises a perforated barrier spaced below said shaped applicator, said perforated barrier defining a space below said shaped applicator which is separated from the space of the interior of said container body.

3. A liquid applicator according to claim 2 in which said venting means comprises at least one vertically extending channel cut in said shaped applicator.

4. A liquid applicator according to claim 2 in which said container is provided with a hollow neck extending upwardly from said container body and communicating with the interior thereof, said venting means comprising at least one vertically extending channel cut into the interior surface of said hollow neck.

5. A liquid applicator according to claim 4 including a sealing flange extending outwardly on the external surface of said hollow neck; said applicator also being provided with a cap that fits over said hollow neck and engages said sealing flange in a sealing relationship.

6. A liquid applicator according to claim 1 in which said applicator means is releasibly secured in said opening of said container.

7. A liquid applicator according to claim 1 including a collecting channel disposed adjacent said applicator means adapted to collect overflow liquid coming through the pores of said shaped applicator and directing it back into said container.

8. A liquid applicator according to claim 1 in which the pore size of said applicator means is in the range of from about 10 to 500 microns.

9. A liquid applicator according to claim 1 in which the pore size of said applicator means is in the range of from about 20 to 200 microns.

10. A liquid applicator according to claim 1 in which said shaped applicator means is in the form of a hemisphere and is adapted for application to the axilla of humans.

* * * * *